US010670333B2

(12) United States Patent
Nanos et al.

(10) Patent No.: US 10,670,333 B2
(45) Date of Patent: Jun. 2, 2020

(54) MODULAR WATER COOLER AND METHOD

(71) Applicant: Elkay Manufacturing Company, Oak Brook, IL (US)

(72) Inventors: Nicholas M. Nanos, Crystal Lake, IL (US); Damon D. Shaw, Stillman Valley, IL (US); Nikolay V. Popov, Naperville, IL (US); Jonathan Chee Yeen Chong, Chicago, IL (US); Kirk V. Streitmatter, Washington, IL (US); Alexander R. Greenhill, Wonder Lake, IL (US); Scott W. Matulik, Lemont, IL (US); Trevor D. Craig, Washington, IL (US); John Conway, Oak Brook, IL (US); Matthew Chapman, Wheeling, IL (US)

(73) Assignee: Elkay Manufacturing Company, Downers Grove, IL (US)

( * ) Notice: Subject to any disclaimer, the term of this patent is extended or adjusted under 35 U.S.C. 154(b) by 105 days.

(21) Appl. No.: 15/958,934

(22) Filed: Apr. 20, 2018

(65) Prior Publication Data

US 2018/0306492 A1 Oct. 25, 2018

Related U.S. Application Data

(60) Provisional application No. 62/488,546, filed on Apr. 21, 2017.

(51) Int. Cl.
*F25D 31/00* (2006.01)
*F25D 19/00* (2006.01)
(Continued)

(52) U.S. Cl.
CPC ..... *F25D 31/002* (2013.01); *F25D 19/00* (2013.01); *B67D 1/06* (2013.01); *B67D 1/08* (2013.01);
(Continued)

(58) Field of Classification Search
CPC ..... F25D 31/002; F25D 19/02; B67D 1/0858; B67D 1/06; B67D 1/08; B67D 2210/00034
See application file for complete search history.

(56) References Cited

U.S. PATENT DOCUMENTS 1,873,425 A * 8/1932 King ..... F25D 11/04 62/448
1,959,366 A 5/1934 Kellogg
(Continued)

FOREIGN PATENT DOCUMENTS

WO WO 2010/043009 A2 4/2010

*Primary Examiner* — Frantz F Jules
*Assistant Examiner* — Lionel Nouketcha
(74) *Attorney, Agent, or Firm* — Neal, Gerber & Eisenberg LLP; Tanvi Patel; Daniel Organ

(57) ABSTRACT

A self-contained water cooler module for use with a water dispenser includes a chassis. The chassis includes a back panel, a pair of spaced side panels extending forwardly from the back panel, a bottom panel extending forwardly from the back panel and attached to bottom edges of the pair of spaced side panels, and the back panel, side panels and bottom panel are constructed of a single, unitary sheet. A strut interconnects front edges of the pair of spaced side panels. A support bracket interconnects the back panel and the horizontal frame member. A refrigeration unit includes an evaporator, a condenser, a fan and motor assembly, and a compressor. The refrigeration unit is attached to the chassis. A water storage tank is configured to receive cooled water from the refrigeration unit. The chassis is configured to be attached to and detached from the water dispenser via a tool-free connection.

3 Claims, 14 Drawing Sheets

(51) Int. Cl.
*F25D 19/02* (2006.01)
*B67D 1/08* (2006.01)
*B67D 1/06* (2006.01)

(52) U.S. Cl.
CPC .. *B67D 1/0858* (2013.01); *B67D 2210/00034* (2013.01); *F25D 19/02* (2013.01); *F25D 2317/068* (2013.01)

(56) References Cited

U.S. PATENT DOCUMENTS 2,010,504 A 8/1935 Askin
2,051,604 A * 8/1936 Hull ..... F25D 19/02 62/448
3,033,007 A * 5/1962 Lyman ..... F25D 31/002 62/298
3,069,872 A 12/1962 Sorensen et al.
3,179,292 A 4/1965 Terry
3,206,943 A 9/1965 Rice et al.
3,712,078 A 1/1973 Maynard et al.
4,416,122 A 11/1983 Johnson
4,733,543 A * 3/1988 Blair ..... F24F 1/0003 312/236
4,881,380 A 11/1989 Mrugala et al.
5,493,873 A 2/1996 Donselman et al.
5,553,935 A * 9/1996 Burnham ..... B67D 3/00 312/265.3
6,123,232 A * 9/2000 Donselman ..... B67D 3/00 141/364
6,508,070 B1 1/2003 Palmer
D504,138 S 4/2005 Fee et al.
8,277,001 B2 * 10/2012 Vincent ..... H05K 7/1488 312/294
2004/0003600 A1 1/2004 Hawkins, Jr. et al.
2004/0134221 A1 7/2004 Fee et al.
2005/0056041 A1 3/2005 Jin
2009/0090119 A1 4/2009 Dietschi et al.
2010/0133290 A1 * 6/2010 Luntz ..... F25D 19/02 221/97
2012/0023983 A1 * 2/2012 Glaros ..... A47F 3/0482 62/125
2012/0291475 A1 11/2012 Cur et al.
2017/0183210 A1 6/2017 Wyatt et al.
2017/0291807 A1 10/2017 Jeon
2017/0292782 A1 10/2017 Joyer et al.

* cited by examiner

MODULAR WATER COOLER AND METHOD

CROSS-REFERENCE TO RELATED APPLICATIONS

This patent application claims the benefit of U.S. Provisional Patent Application Ser. No. 62/488,546, filed Apr. 21, 2017, which is incorporated by reference in its entirety.

TECHNICAL FIELD OF THE DISCLOSURE

The present invention relates to water coolers and, more specifically, to water fountains having a refrigeration unit for cooling the dispensed water.

BACKGROUND OF THE INVENTION

Water coolers of a certain type are wall-mounted devices that combine a water fountain with a refrigeration unit, which cools the water dispensed from the water fountain, bottle filling station and the like. This type of water cooler is typically used indoors or outdoors and is generally self-contained by incorporating all water supply and cooling functions within a combined housing or fixture. Typical devices can include a refrigeration unit, which includes a condenser coil, a compressor and an evaporator coil, through which a refrigeration fluid such as R134a circulates. These various components are attached to a chassis of the water cooler fixture, much like a common, household refrigerator. In typical water coolers, removal of any one of the condenser, the compressor, or the evaporator for maintenance or replacement involves significant effort because the appliance is usually attached permanently to a wall and cannot easily be removed or replaced in its entirety. Moreover, the mounting height of the water cooler, which is selected to be low enough to accommodate most users, further hinders access to its internal components for service, and often requires service personnel to lie on the ground while working on the cooler's internal components.

BRIEF SUMMARY

One embodiment of the disclosure is a self-contained water cooler module for use with a water dispenser, including a chassis. The chassis includes a back panel, a pair of spaced side panels extending forwardly from the back panel, a bottom panel extending forwardly from the back panel and attached to bottom edges of the pair of spaced side panels, and the back panel, side panels and bottom panel are constructed of a single, unitary sheet. A strut interconnects front edges of the pair of spaced side panels. A support bracket interconnects the back panel and the horizontal frame member. A refrigeration unit includes an evaporator, a condenser, a fan and motor assembly, and a compressor. The refrigeration unit is attached to the chassis. A water storage tank is configured to receive cooled water from the refrigeration unit. The chassis is configured to be attached to and detached from the water dispenser by way of a tool-free connection.

BRIEF DESCRIPTION OF THE SEVERAL VIEWS OF THE DRAWINGS

FIG. 19 is a perspective view of the chassis of the assembly of FIG. 17.

DETAILED DESCRIPTION

Figure 2:
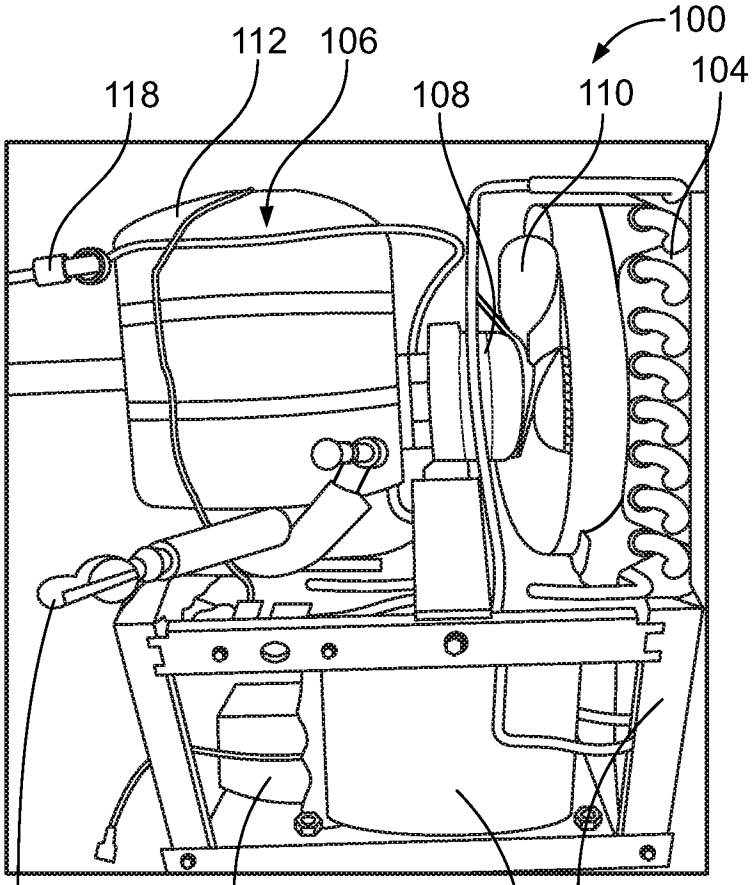
FIGS. 1 and 2 are outline views of a modular water cooler in accordance with the disclosure.
Figure 1:
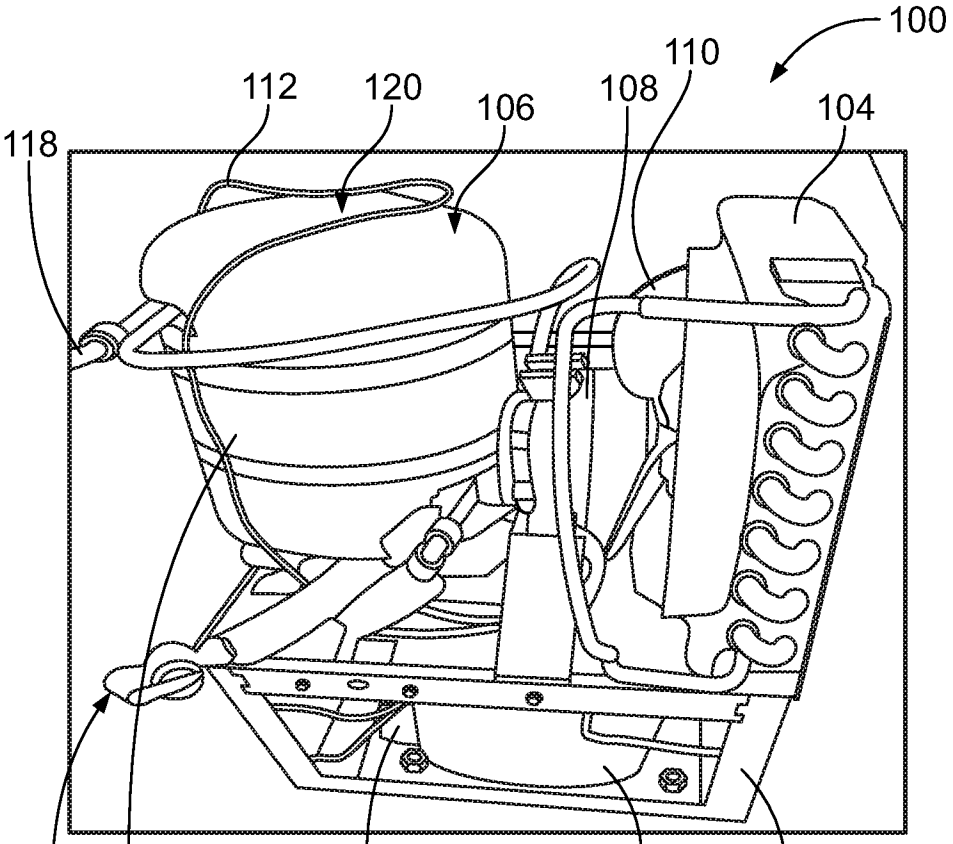

In the drawings, which form a part of this specification, a water cooler module 100 is shown in FIGS. 1 and 2. The modular water cooler 100 is advantageously configured to include various functional components, including a compressor 102, a condenser 104 (which may be a liquid to air heat exchanger), an evaporator 106 (which may be a liquid/gas to liquid heat exchanger), a motor 108 driving a fan 110, and other components such as a thermocouple 112 and a controller 114, and possibly other or additional components such as a water filter, all mounted onto a chassis 116.

Significantly, the water cooler module 100 is self-contained, meaning, the water cooler module 100 includes all components necessary for carrying out the function of admitting water from a source, for example, a tap, through an inlet conduit 118, and operating a refrigeration cycle to cool the water provided through the inlet conduit 118. The cooled water is provided to an outlet conduit 128 to supply a drinking fountain, bottle filling station and the like. In one embodiment, the cooling of a stream or stored quantity of water occurs in an evaporator arrangement 120, which may entwine a water coil with a coil of the evaporator 106 and/or, alternatively, wind the coil of the evaporator 106 around a water storage tank 122 to cool a greater quantity of water for subsequent use.

Figure 4:
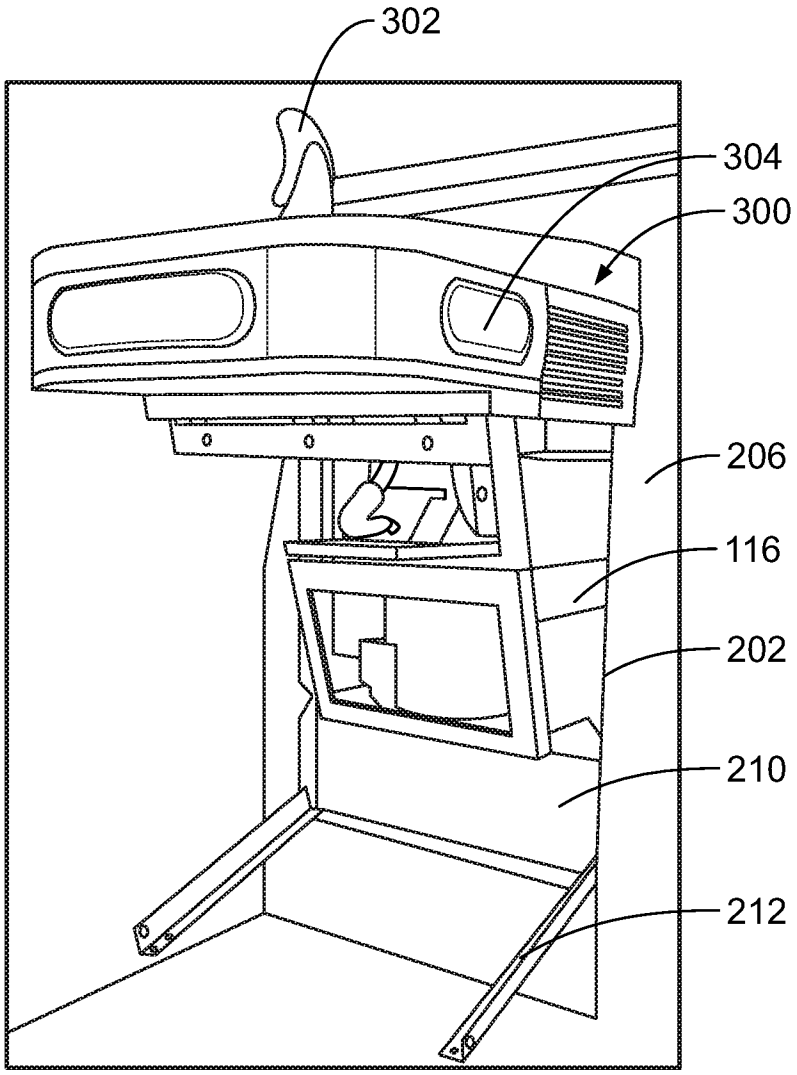
FIG. 4 is a view of the modular cooler installed in a water dispenser in accordance with the disclosure.
Figure 3:
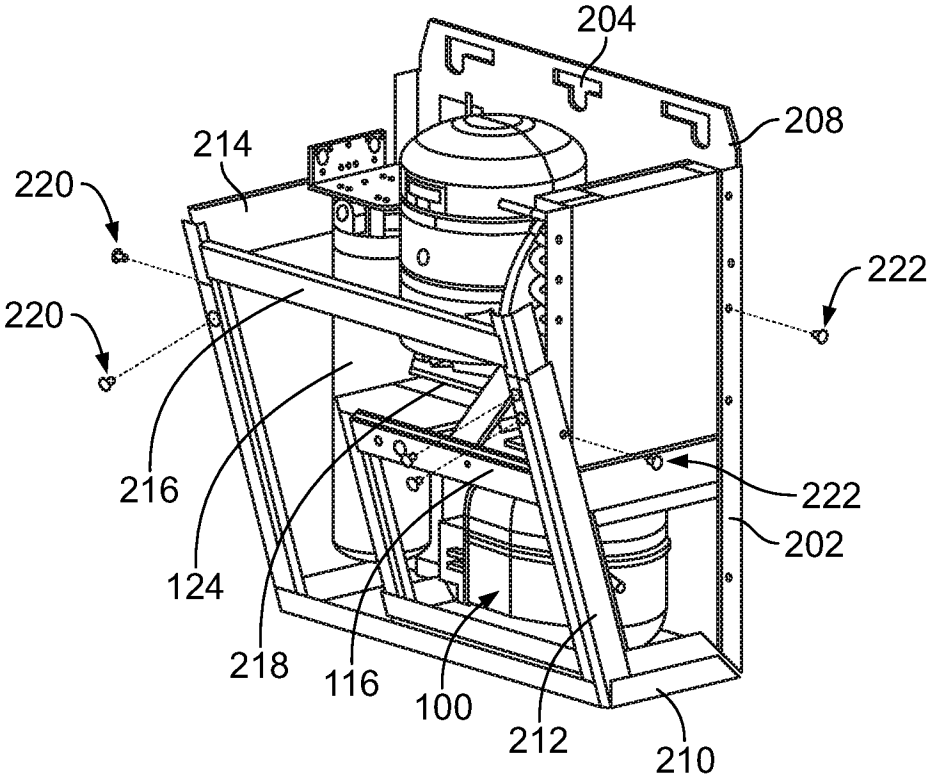
FIG. 3 is a perspective view of a modular water cooler installed into a dispenser frame in accordance with the disclosure.

Advantageously, the water cooler module 100 is removable and insertable into a water cooler and/or bottle filling station as a module for ease of service and replacement. To accomplish this, the chassis 116 can be inserted into a housing 202 of a water cooler 300, as shown in FIGS. 3 and 4, which illustrate the water cooler 300 in partially disassembled states for purpose of discussion. The housing 202 has various openings 204 for mounting onto a wall 206 and includes a back panel 208, a bottom panel 210, front struts 212, horizontal struts 214 and a face strut 216, which together form an enclosure that houses, surrounds and supports the chassis 116 having the water cooler module 100 assembled thereon. In the embodiment illustrated in FIG. 3, the water cooler module 100 further includes an optional water filter 124, although the water filter may be attached directly to the water cooler 300, which is disposed in-line with the inlet conduit 118 (FIG. 2).

The housing 202 further includes a shelf 218 that vertically supports the water cooler module 100 such that the module can be slid into place in the housing 202. The bottom panel 210 and front struts 212 are hinged to open and allow insertion and removal of the water cooler module 100 into and out from the housing 202. The water cooler module 100 is secured into the housing when the front struts 212 are fastened to the face strut 216 by fasteners 220. Additional fasteners 222 secure the water cooler module 100 to the housing 202 to slidably engage the chassis 116 after it has been inserted into the housing 202. FIG. 4 illustrates an intermediate assembly or disassembly condition in which the bottom panel 210 and front struts 212 are in their open position to permit the sliding of the chassis 116 into and out from the housing 202. In this view, it can also be seen that the housing 202, while attached to the wall 206, also supports a water cooler fixture 300 that includes a water dispenser 302, manually operated electrical switches 304, which may activate water valves, and the like. A fluid connection from the inlet conduit 118 to the valves activated by electrical switches 304 so water can flow through the water dispenser 302 are performed in the known fashion and are not shown here for simplicity. Further, a water connection from the wall to the inlet conduit 118, and a power connection to the controller 114 are likewise not shown here.

Figure 6:
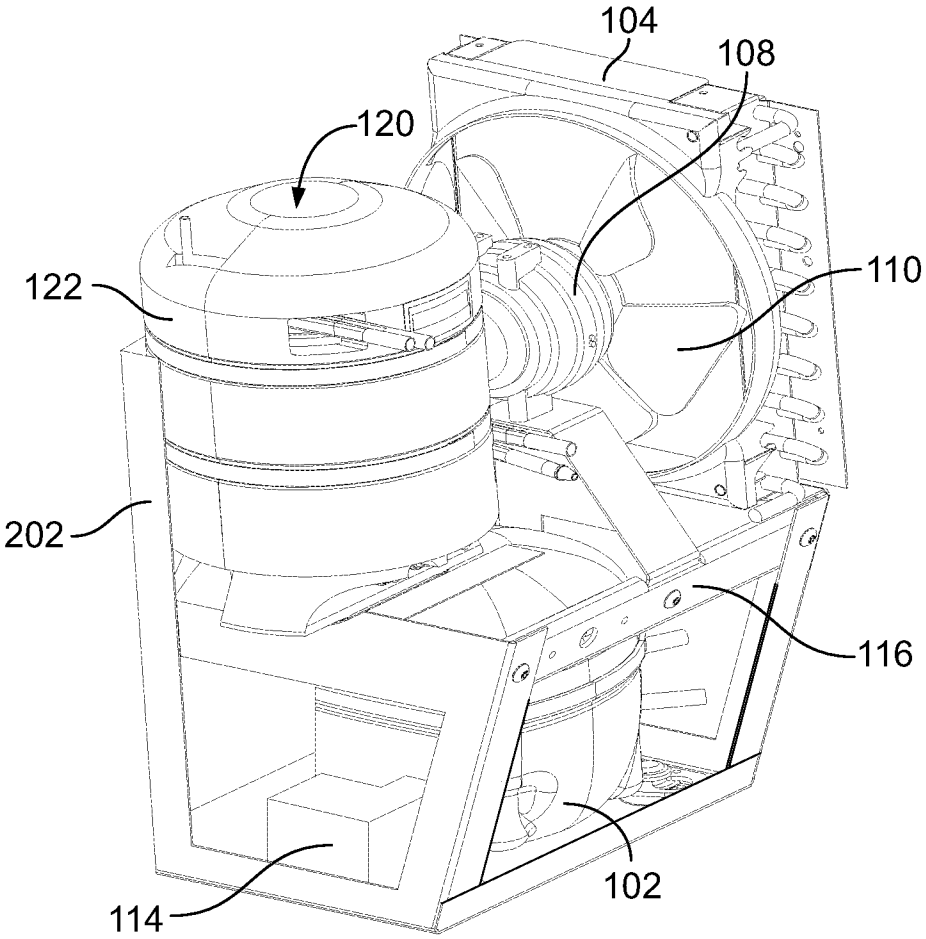
FIG. 6 is a view of the chassis of FIG. 5 with the modular water cooler components assembled thereon.
Figure 5:
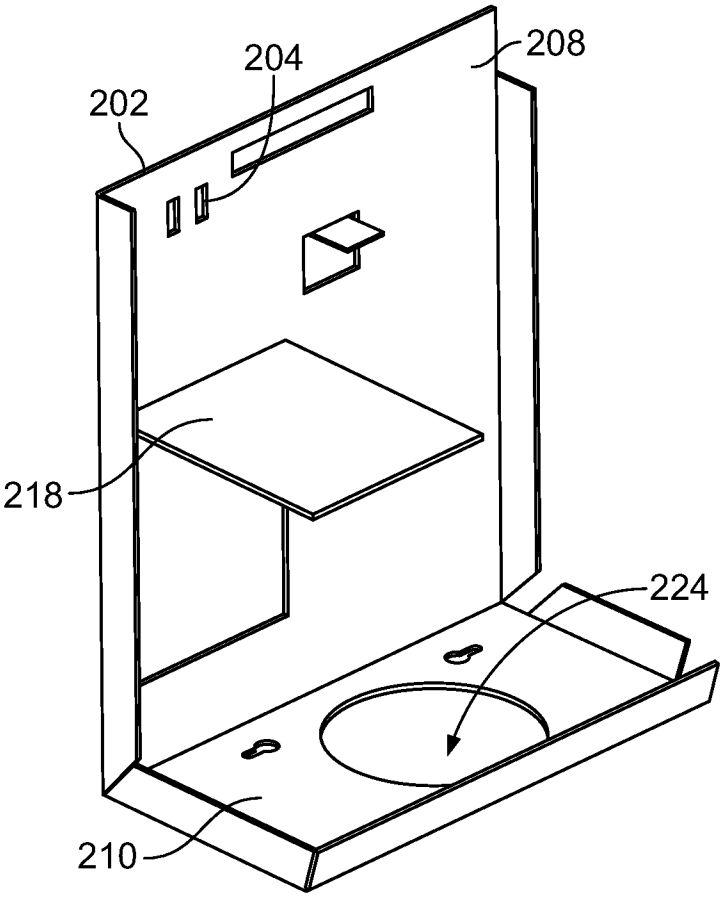
FIG. 5 is a view of a chassis for a modular water cooler.
Figure 8:
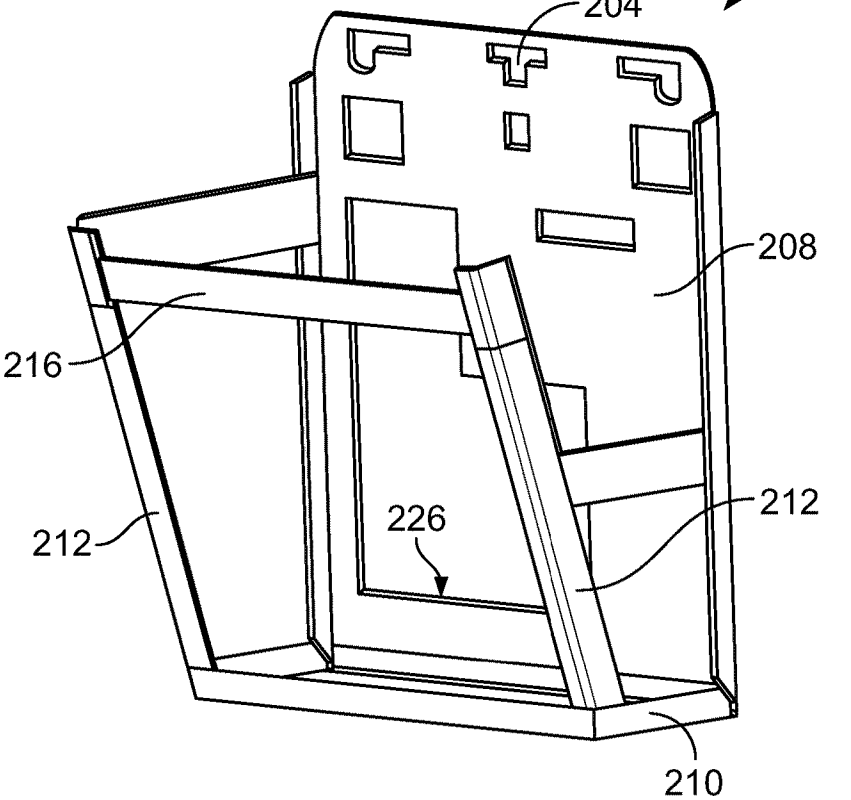
FIGS. 7 and 8 are perspective views of a dispenser frame in two positions in accordance with the disclosure.
Figure 7:
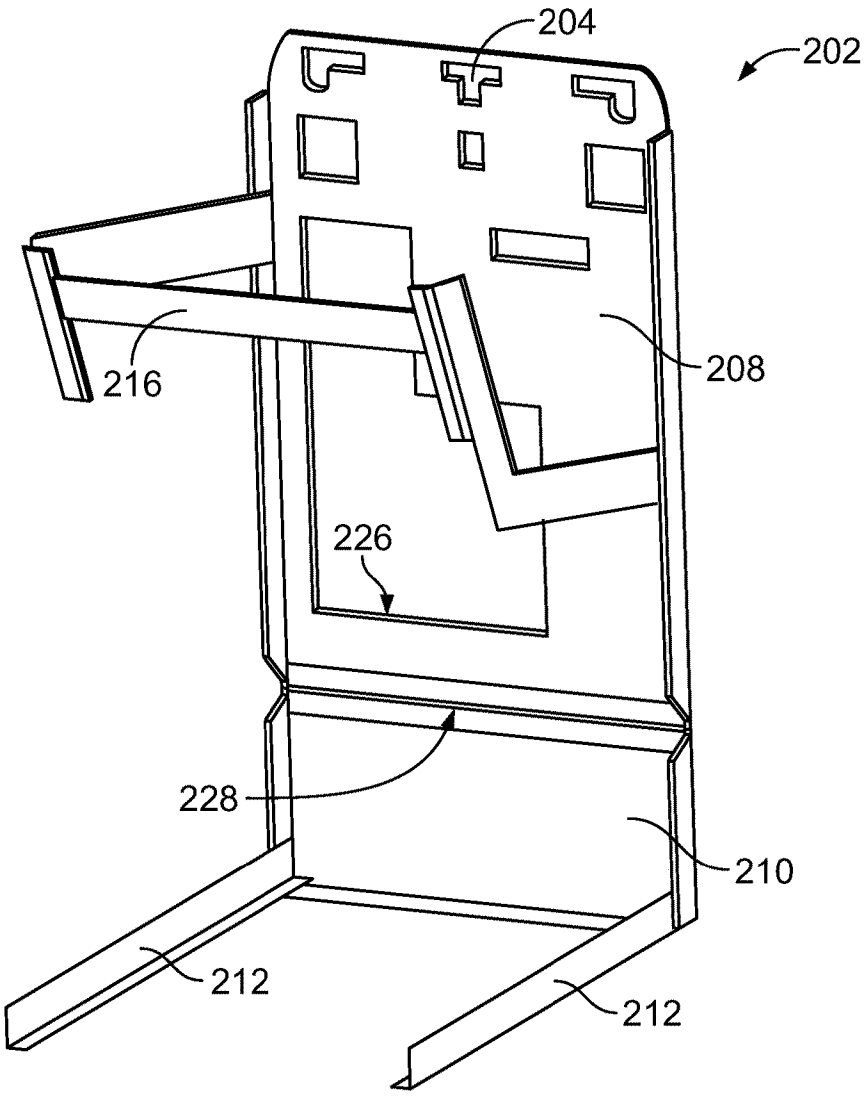
Figure 10:
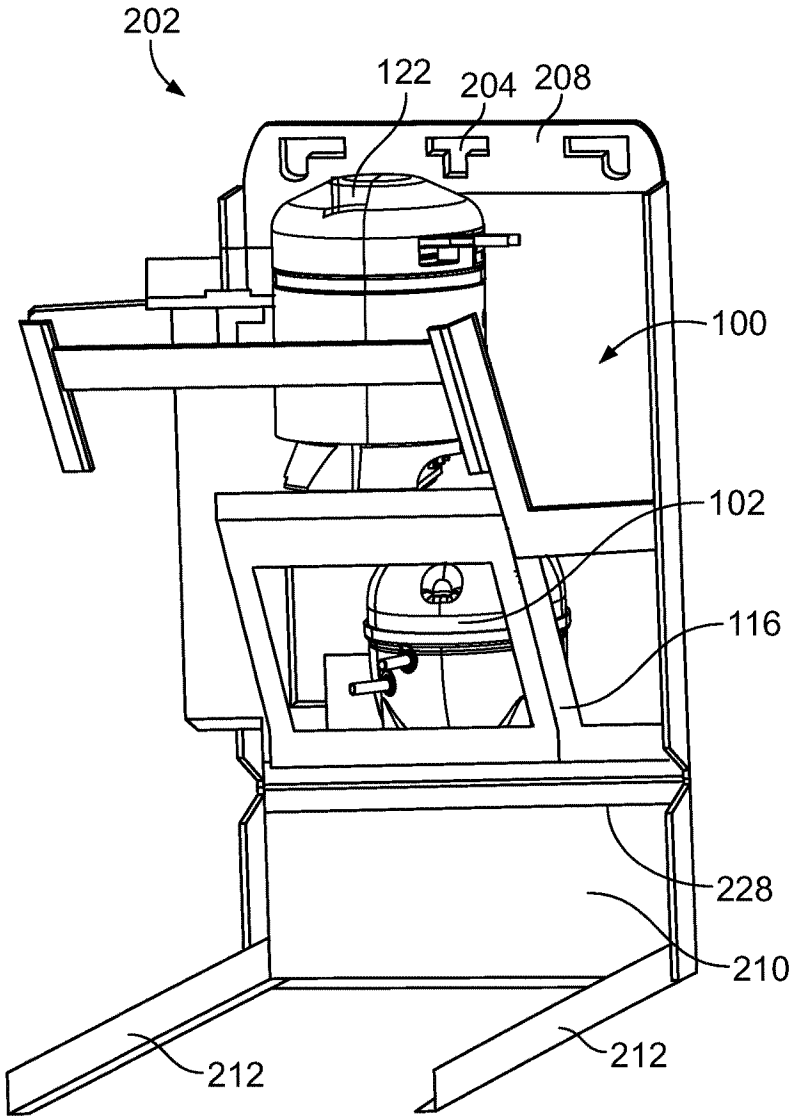
FIGS. 9 and 10 are two alternative embodiments for a dispenser frame with modular water cooler assembled in accordance with the disclosure.
Figure 9:
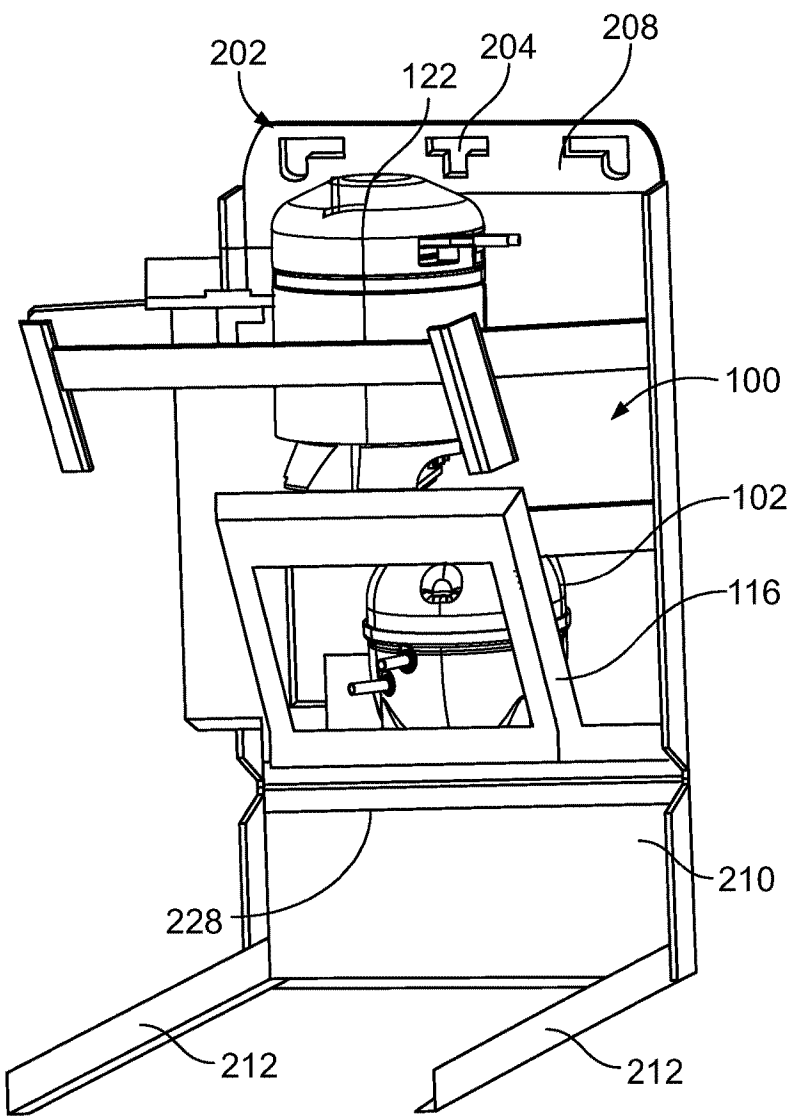

Additional, partially assembled views of the water cooler module 100 onto the housing 202, shown removed from the water cooler 300, are illustrated in FIGS. 5 and 6. In reference to these figures, the shelf 218, which supports the evaporator arrangement 120, which can include a water tank 122, can be seen connected to the back panel 208. The bottom panel 210 in this embodiment further includes an opening 224 to nestle and locate a bottom portion of the compressor 102. Various views of the housing 202 in the open and closed positions are shown in FIGS. 7 and 8, and also in FIGS. 9 and 10, where the water cooler module 100 is also shown in its installed position within the housing. In the embodiment shown in FIGS. 7 and 8, the shelf is omitted in favor of a shaped opening 226 that matingly engages a rear portion of the chassis 116 to thereby support the weight of the water cooler module 100 when the water cooler module is installed into the housing 202, as shown in FIGS. 7 and 8. Moreover, FIG. 7 shows a hinge 228, which rotatably supports the bottom panel 210 to the rear wall 208.

Figure 12:
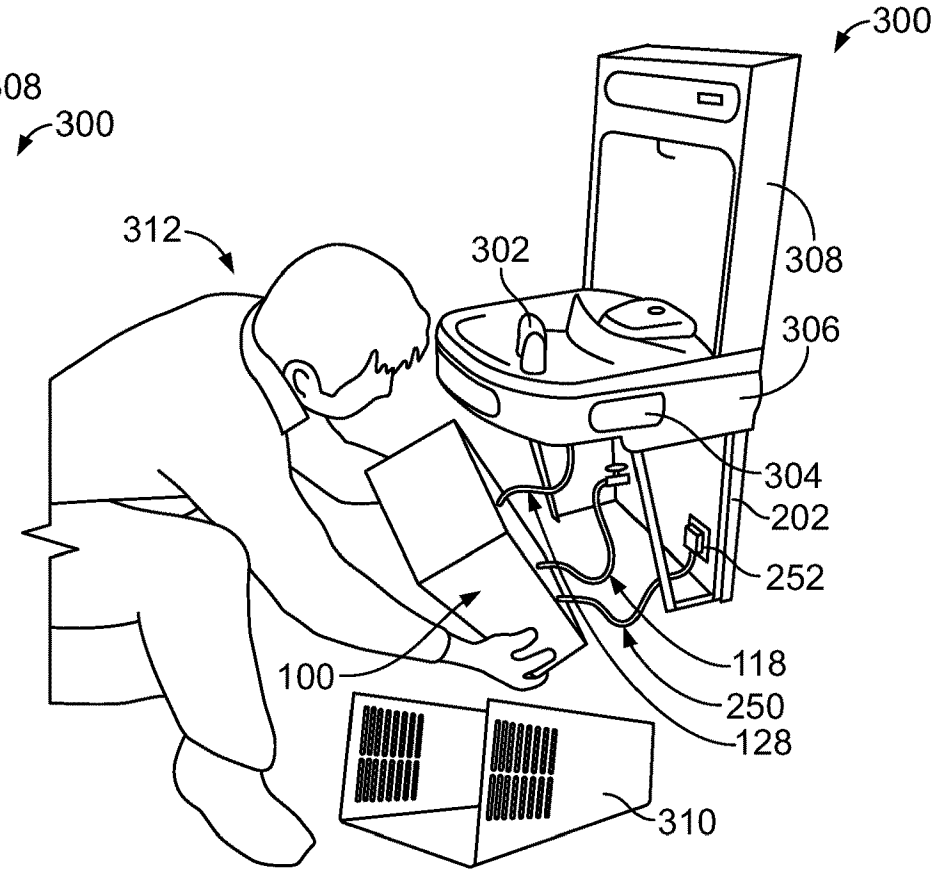
FIGS. 11 and 12 are illustrative views of assembly or disassembly of a modular water cooler in accordance with the disclosure.
Figure 11:
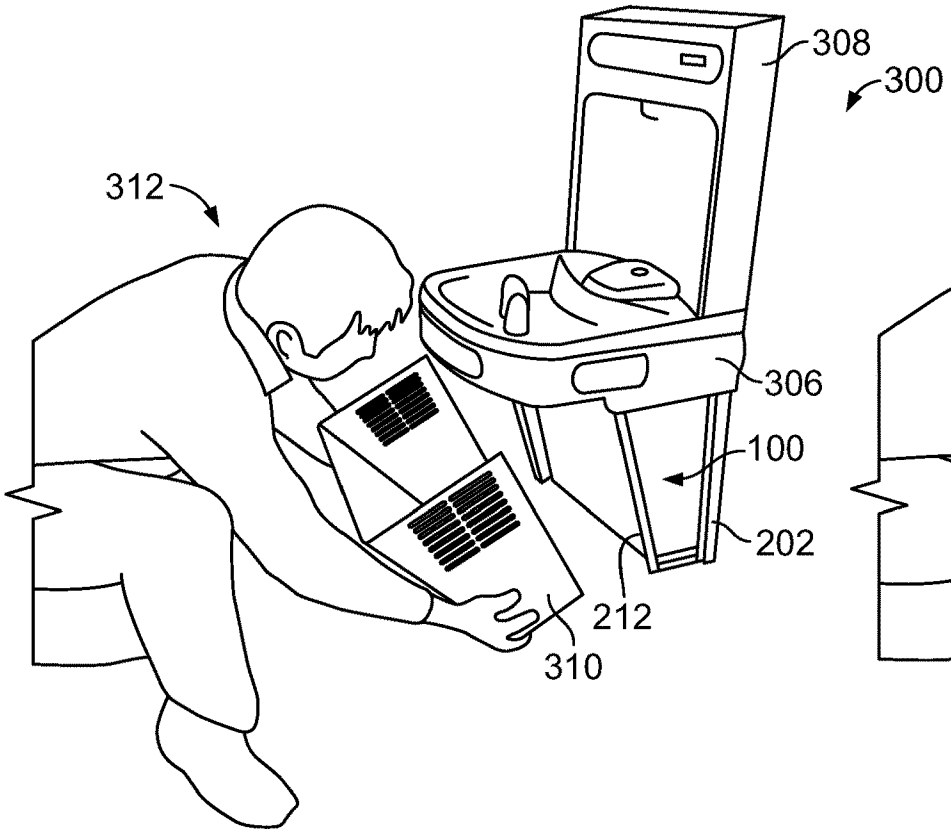
Figure 13:
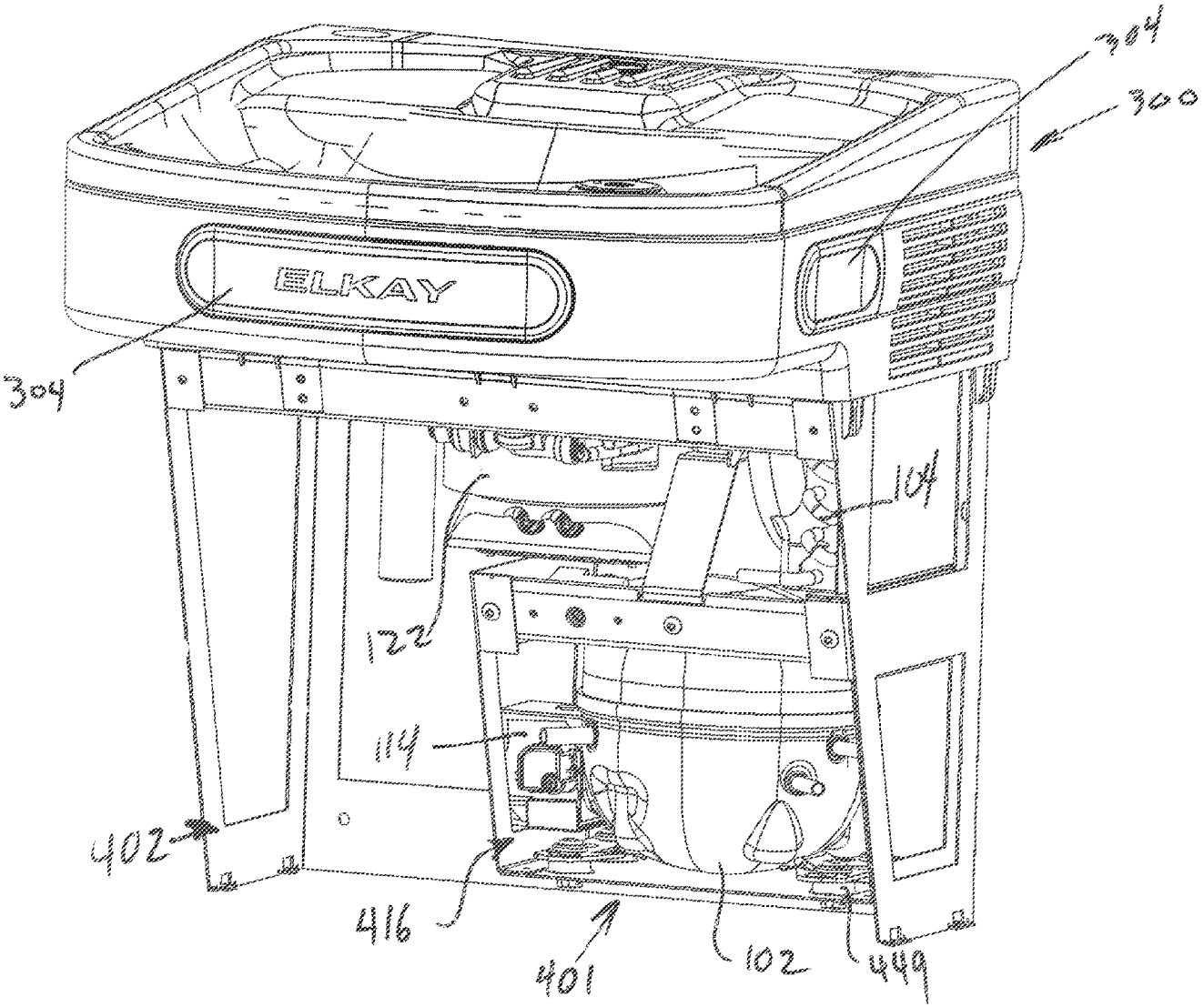
FIG. 13 is a perspective view of a water cooler and drinking fountain according to an embodiment of the disclosure with the front cover removed.

Two illustrations showing steps of a service operation for the water cooler 300 are shown in FIGS. 11 and 12. In these illustrations, it can be seen that the housing 202 is connected to and supports the fixture 300, which in this embodiment includes a drinking fountain fixture 306 and also a bottle filling station 308, each of which is connected to and arranged to receive cooled water from the outlet conduit 128. The water cooler 300 further includes a front cover 310, which is removably connected to the front struts 212 and/or to other structures of the housing 202. For removing a water cooler module 100 from the water cooler 300 for replacement or service, a user 312 first removes the front cover 310, as shown in FIG. 11, to expose the water cooler module 100. The user 312 can then unfasten the water cooler module 100 from the housing 202 and pull out chassis 116 and all components mounted thereto. For a complete removal and disconnection, the user 312 can also disconnect the water connections to the water inlet conduit 118 and the water outlet conduit 128, and also an electrical conduit 250 from a wall receptacle 252, before entirely removing and disconnecting the water cooler module 100 from the water cooler 300. Reassembly of the water cooler module 100 can be carried out in the reverse order.

A further embodiment of a water cooler 400 is shown in FIGS. 13-20. The water cooler 300 includes a water cooler module 401 that is advantageously configured to include various functional components, including a compressor 102, a condenser 104 (which may be a liquid to air heat exchanger), an evaporator 120 (which may be a liquid/gas to liquid heat exchanger), a motor 108 driving a fan 110, and other components such as a thermocouple 112 and a controller 114, and possibly other or additional components such as a water filter, all mounted onto a chassis 416. The chassis 416 and the components mounted thereto is removable as one integrated assembly from the water cooler housing 402.

Significantly, the water cooler module 401 is self-contained, meaning, the water cooler module 401 includes all components necessary for carrying out the function of admitting water from a source, for example, a tap, through an inlet conduit 118 (FIG. 18), and operating a refrigeration cycle to cool the water provided through the inlet conduit 118. The cooled water is provided to an outlet conduit 128 to supply a drinking fountain, bottle filling station and the like. In one embodiment, the cooling of a stream or stored quantity of water occurs in an evaporator 120, which may entwine a water coil with a coil of the evaporator and/or, alternatively, wind the coil of the evaporator 120 around a water storage tank 122 to cool a greater quantity of water for subsequent use.

Figure 14:
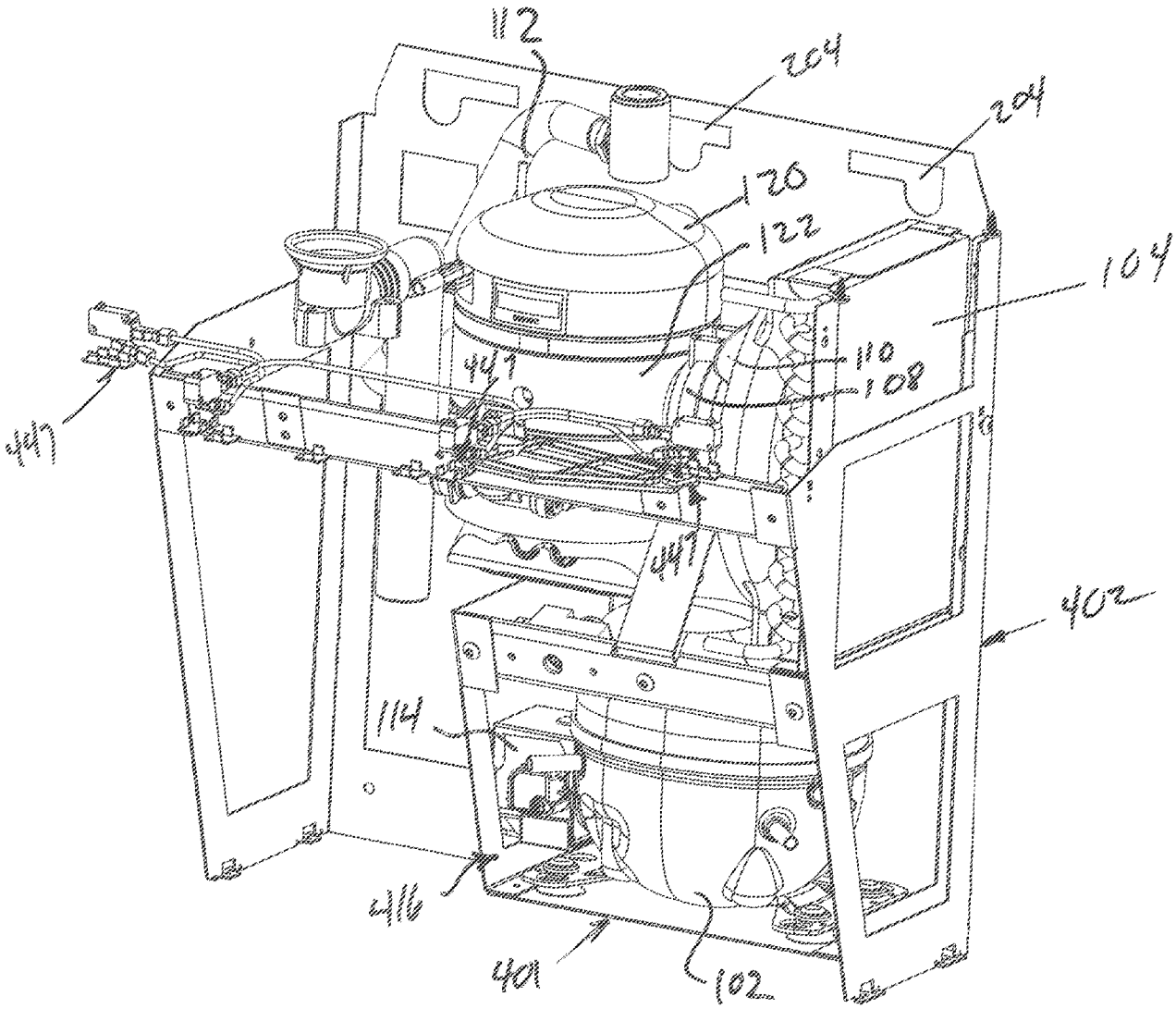
FIG. 14 is a perspective view of the water cooler of FIG. 13 with the shroud, front cover, and basin removed.
Figure 11:
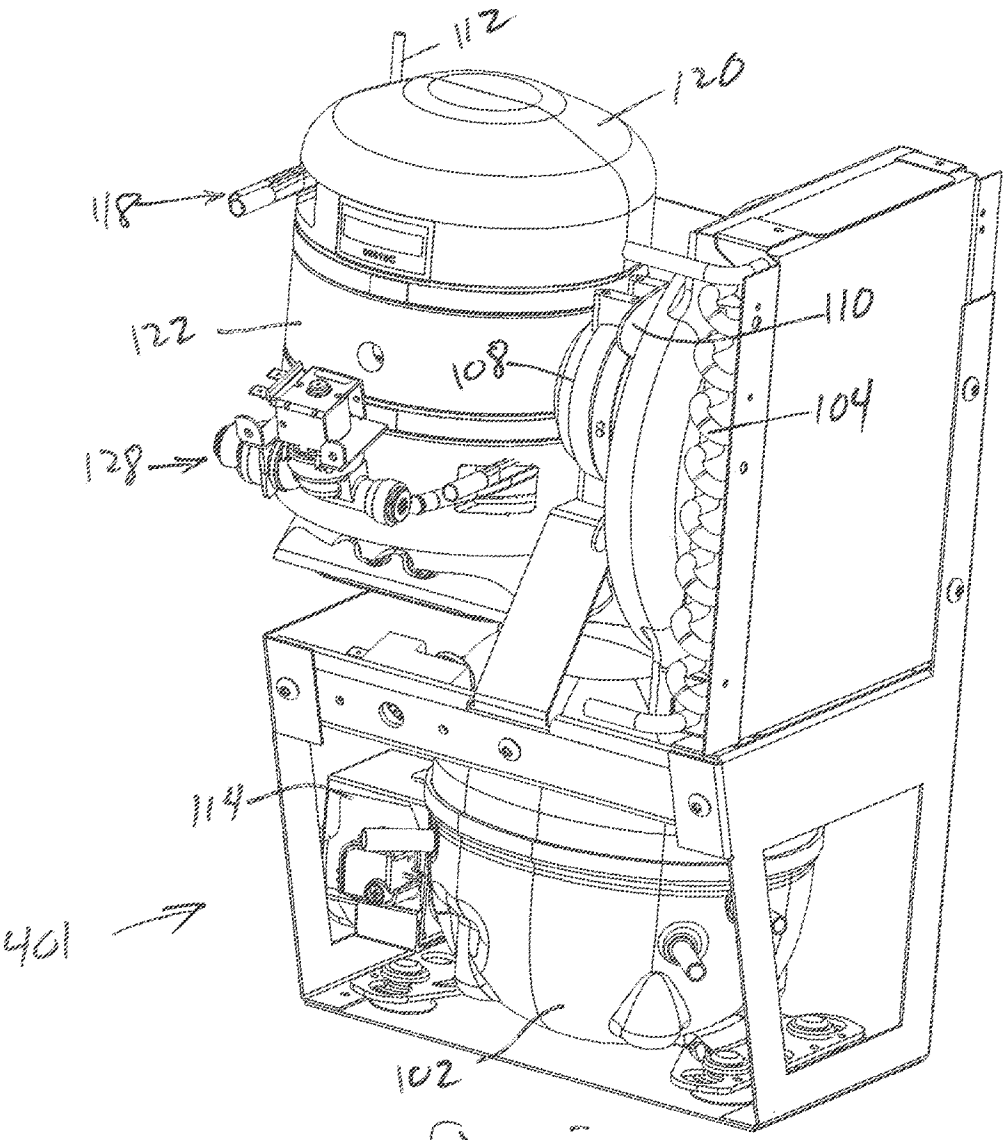
Figure 16:
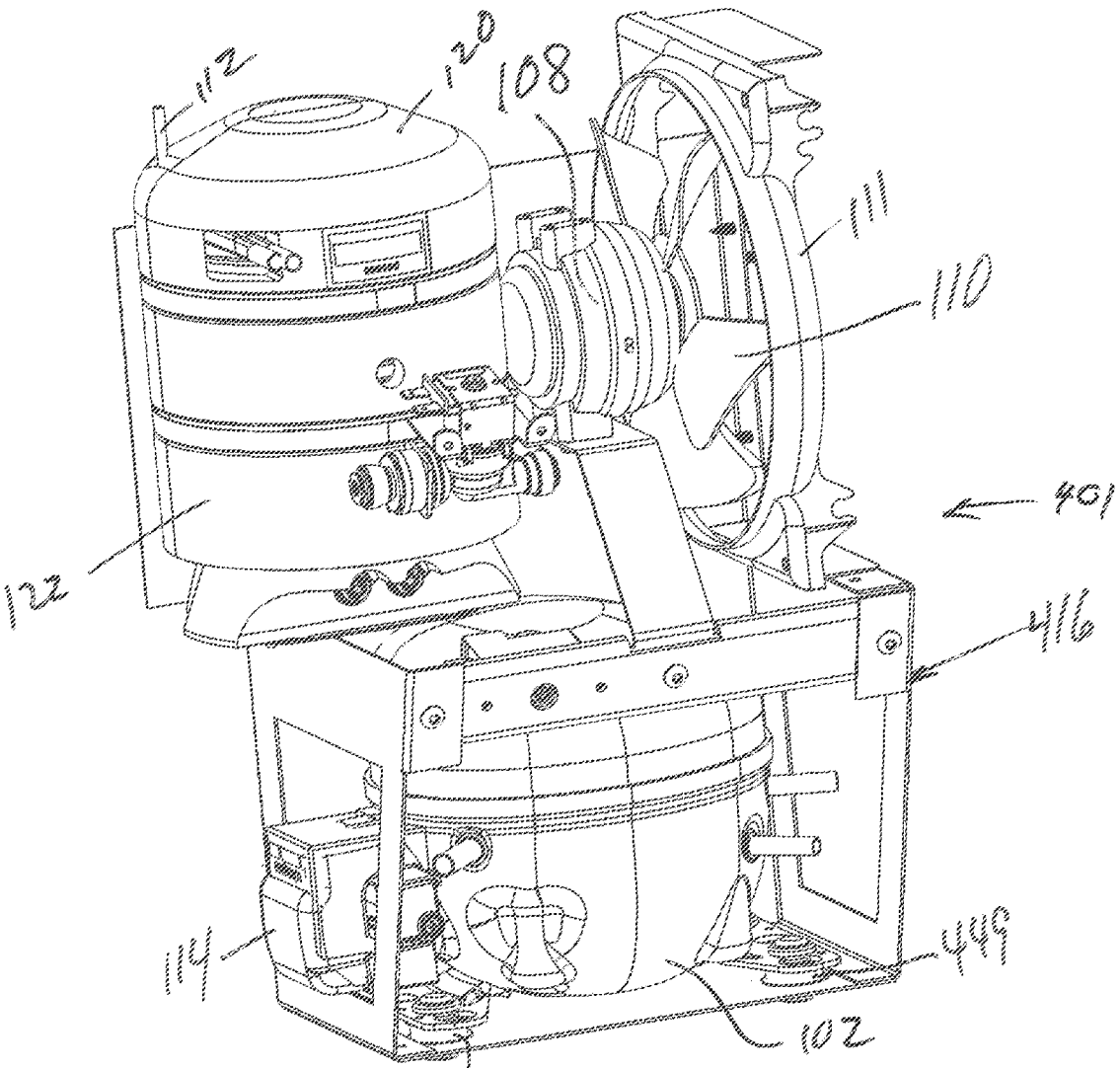
FIGS. 15 and 16 are right and left perspective views of the modular water cooler of FIG. 13.
Figure 17:
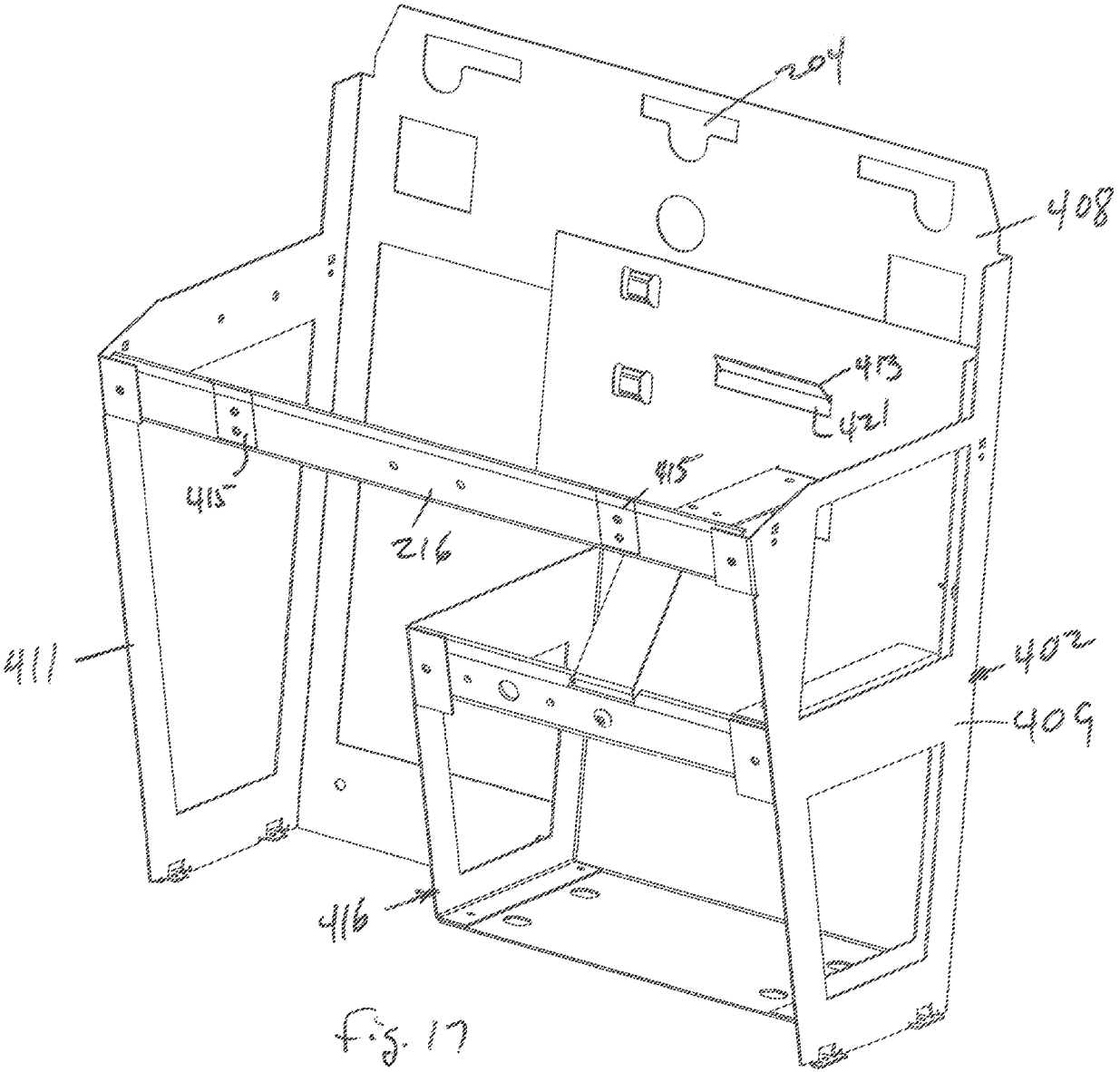
FIG. 17 is a perspective view of the housing and chassis assembly for the cooler of FIG. 13.
Figure 18:
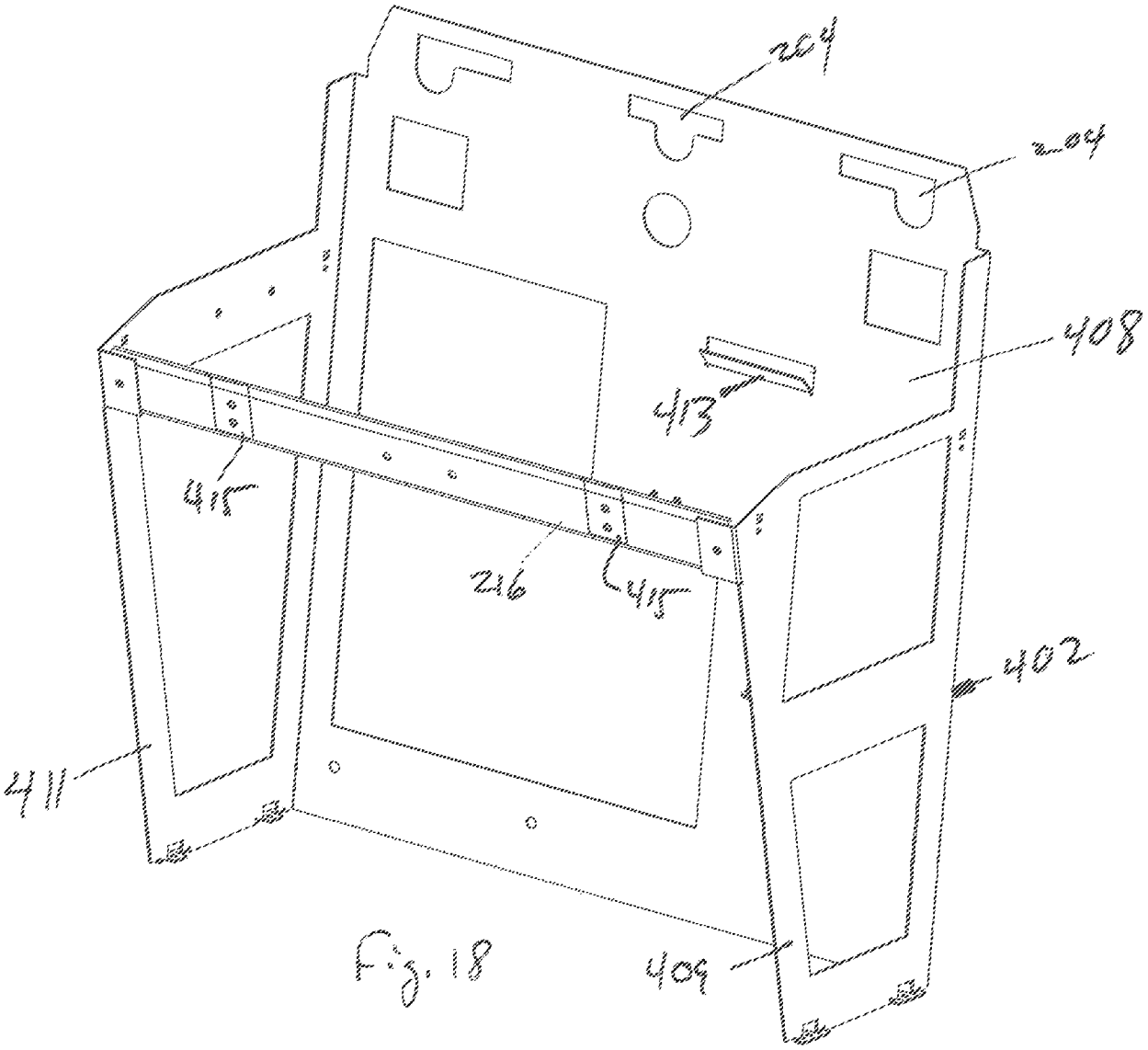
FIG. 18 is a perspective view of the housing of the assembly of FIG. 17.
Figure 15:
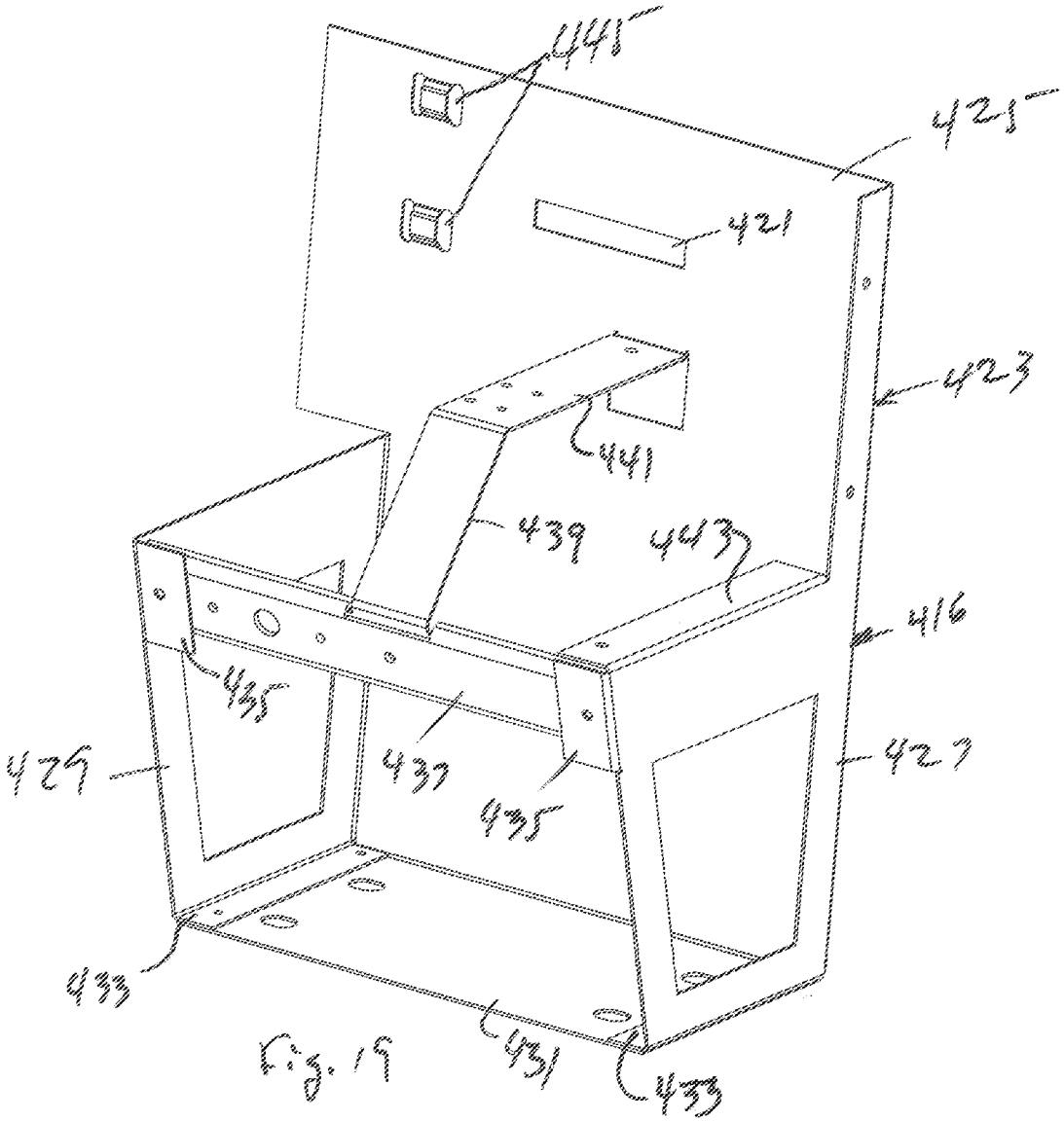

Advantageously, the water cooler module 401 is removable and insertable into a water cooler and/or bottle filling station as a module for ease of service and replacement. To accomplish this, the chassis 416 can be inserted into a housing 402 of a water cooler 300, as shown in FIG. 14, which illustrates the water cooler 300 in a partially disassembled state for purpose of discussion. The housing 402 has various openings 204 for mounting onto a wall as in the previous embodiment and, referring to FIG. 18, includes a back panel 408, a right side panel 409, a left side panel 411 and a face strut 216, which together form an enclosure that houses, surrounds and supports the chassis 416 having the water cooler components assembled thereon as shown in FIGS. 15 and 16. The back panel 408, and side panels 409, 411 are formed from a single, unitary sheet, panel, plate, or the like, of material, such as steel, aluminum, metal, composites or any suitable material. The back panel 408, and side panels 409, 411, can be bent or molded into the final shape illustrated and may be substantially planar or flat and lightened by removing material in non-essential or non-load-bearing areas, such as the center of each of the panels. The face strut 216 interconnects the side panels 409, 411 at upper ends thereof, and may be secured by fasteners, such as screws or rivets or adhesives (not shown). The face strut 216 may be a planar rectangular beam shape. The housing, therefore can be formed from only two pieces of material, which simplifies manufacture and assembly and provides a sturdy framework.

The back panel 408 includes a hanger 413, in the form of an angled tab, ledge or lip, that can be formed by cutting and bending out a flap of material from the material of the housing 402. The hanger 413 can be a rectangular shelf.

Figure 20:
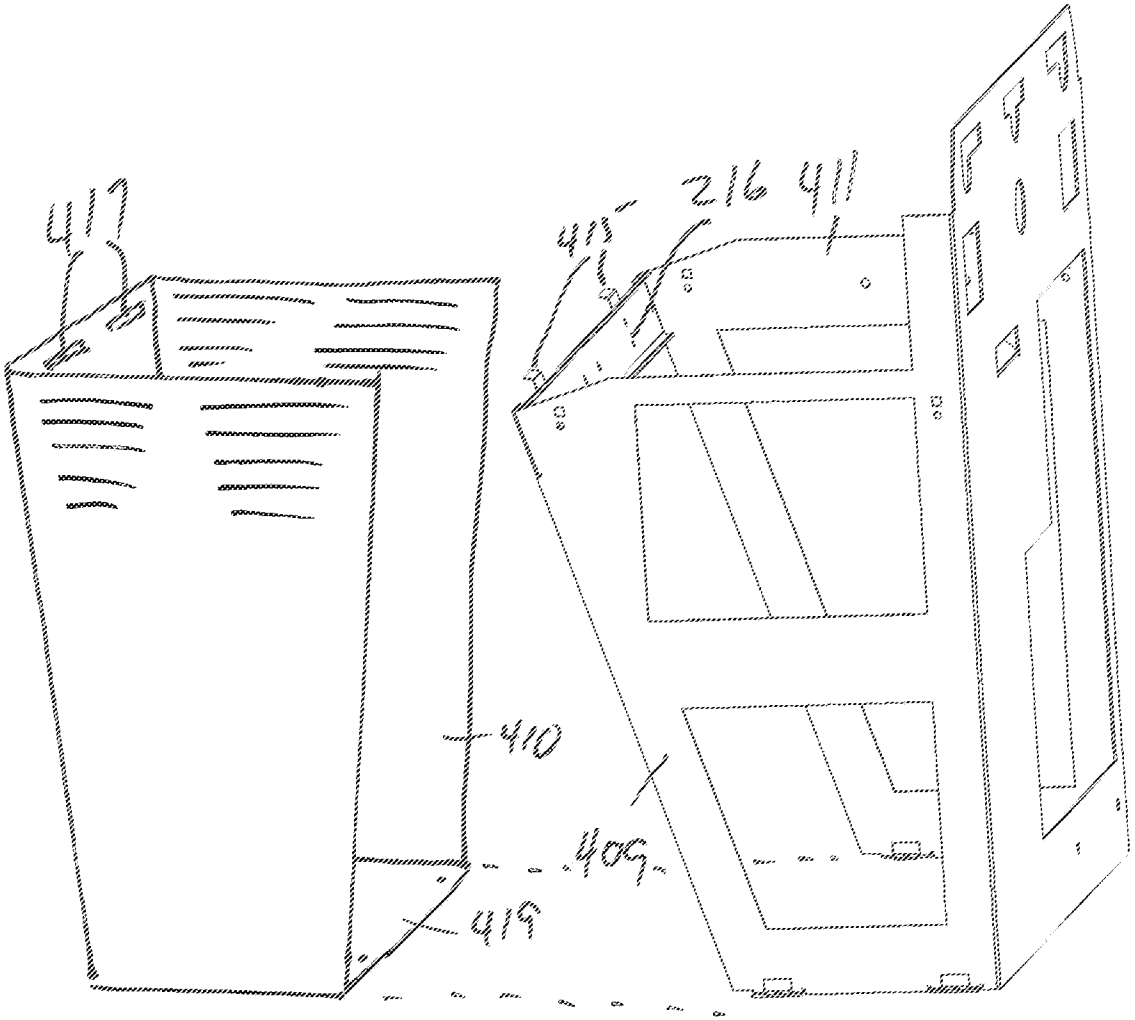
FIG. 20 is a rear perspective view of the housing of FIG. 18 and a detachable front cover.

As shown in FIG. 20, the face strut 216 includes a pair of spaced hooks or clips 415 that are shaped and sized to be inserted into correspondingly shaped and sized slots 417 of a front cover or wrapper 410. The pair of spaced hooks 415 can be angled forwardly and upwardly from the face strut 216. The wrapper 410 is attached to the housing 402 by engaging the slots 417 with the hooks 415 and then securing the bottom panel 419 of the wrapper to the bottom of the side panels 409, 411 with fasteners.

The chassis 416 (shown in FIG. 19) attaches to the housing 402 (shown in FIG. 18) by interaction of the hanger 413 and a cutout 421 in the material of the chassis. The cutout 421 is sized and shaped to receive the hanger 413 therethrough and secure the chassis 416 to the housing 402 without the use of tools or any additional fasteners. Therefore, the hanger 413 and cutout 421 form a tool-free connector or connection. The tool-free connection can be formed of other suitable mechanisms with the object of providing an easy method for one person to engage and disengage the module 401 without the use of tools. However, additional fasteners may be used to further secure the module 401 in position.

The chassis 416 may be formed of at least one structural member or element and in one embodiment is constructed of three main sections. A main panel 423 includes a back panel 425, two opposed side panels 427, 429, and a bottom panel 431, which can be formed of a single sheet of material, in a manner similar to the housing 402. The side panels 427, 429 are bent or molded forward from the back panel 425 at an angle approximately 90 degrees. The term "forward" refers to the direction from the back panel 425 and away from a wall on which the module 401 is disposed. The side panels 427, 429 can each include a bottom tab 433 angled to attach the bottom panel 431 to the side panels. The side panels 427, 429 also can each include a front tab 435 that folds inwardly to interconnect the side panels via a chassis strut 437 that spans the distance therebetween. The chassis strut 437 can also support a support bracket 439 that can be angled and spans the distance between the chassis strut and the back panel 425. The support bracket 439 can include a platform 441 for supporting components of the cooler module 401 as will be shown in more detail herein. The right side panel 427 can include a platform 443 that is bent into a horizontal orientation to support components of the cooler module 401. The back panel 425 can include at least one attachment point 445, which can, in one embodiment, include a horizontal slot or opening sized and shaped to receive a corresponding hook, tab, post, hanger or the like of a component as will be discussed herein.

Returning to FIGS. 13 and 14, panels 304 are movable to actuate manually operated electrical switches 447, which can activate water valves, and the like. A fluid connection from the inlet conduit 118 to the valves activated by electrical switches 304 so water can flow through the system and is ultimately dispensed to the user. Further, a water connection from the wall to the inlet conduit 118, and a power connection to the controller 114 are likewise not shown here.

Referring to FIGS. 16 and 19, the evaporator arrangement 120, which can include a water tank 122, is connected to the back panel 425 of chassis 416 via attachment points 445. The motor 108 is fastened to the platform 441 of the support bracket 439. The fan 110, which is coupled to the motor 108, includes a shroud 111, which is attached to the platform 443 as is the condenser 104 (FIG. 15). The compressor 102 is mounted to the bottom panel 431 via elastic mounts 449 to isolate the vibrations generated by the compressor.

FIG. 14 shows the cooler module 401 attached to the housing 402. The cooler module 401 can be removed from the housing (after the front cover 410 is removed) by raising the cooler module 401 to disengage the cutout 421 and hanger 413 after the water and electrical connections are detached. The cooler module 401 can, after disengagement, be lowered from inside the housing 402 and withdrawn therefrom so as to provide easy access to the components for maintenance, repair, or replacement. The disconnection of the water and electrical connections can be made with the use of conventional quick-connect attachments. The module 401 after removal is shown in FIGS. 15 and 16. Reassembly can be carried out in the reverse order.

It will be appreciated that a modular assembly including a compressor, condenser and evaporator, arranged on a chassis, can be utilized in a freestanding water cooler or water bottle filling station to facilitate removal of the chassis and service of the components of the modular assembly attached thereto.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A water cooler, comprising:

a housing, comprising:

a back panel, first and second spaced apart side panels extending from the back panel, the back panel and the first and second spaced apart side panels constructed of a single, unitary sheet, a face strut interconnecting front edges of the first and second spaced apart side panels, and a hanger disposed on the back panel; and a self-contained water cooler module sized and shaped to be received within the housing, the module comprising:

a chassis including at least one structural member configured to be attached to and detached from the housing by way of a tool-free connection, wherein the tool free connection includes a slot defined by the chassis, the slot sized and shaped to receive the hanger therethrough;

a refrigeration unit attached to the chassis, the refrigeration unit including an evaporator, a condenser, a motor and fan assembly, and a compressor configured to cool a source of water; and a water storage tank disposed on the chassis, the water storage tank configured to receive the cooled water from the refrigeration unit.

2. The water cooler module of claim 1, wherein the chassis includes:

a chassis back panel, first and second spaced apart chassis side panels extending forwardly from the chassis back panel, and a chassis bottom panel extending forwardly from the chassis back panel and attached to bottom edges of the first and second spaced apart chassis side panels, wherein the chassis back panel, first and second spaced apart chassis side panels, and chassis bottom panel are constructed of a single, unitary sheet, a chassis strut interconnecting front edges of the first and second spaced apart chassis side panels, and a support bracket interconnecting the chassis back panel and the chassis strut.

3. A wall-mount water cooler comprising:

a housing configured to be mounted to a wall, the housing comprising:

a back panel, first and second spaced apart side panels extending from the back panel, the back panel and the first and second spaced apart side panels constructed of a single, unitary sheet, a face strut interconnecting front edges of the first and second spaced apart side panels, and a hanger disposed on the back panel; and a self-contained water cooler module sized and shaped to be disposed within the housing, the module comprising:

a chassis including at least one structural member, the chassis configured to be attached to and detached from the housing by way of a tool-free connection, the tool-free connection comprising a slot defined by the chassis, the slot sized and shaped to receive the hanger therethrough, a refrigeration unit attached to the chassis, the refrigeration unit including an evaporator, a condenser, a motor and fan assembly, and a compressor, wherein the refrigeration unit is fluidly coupled to a source of water and configured to receive the water from the source of water at a first temperature and decrease the temperature of the received water from a first temperature to a second temperature relatively lower than the first temperature, and a water storage tank configured to receive and store the water at the second temperature from the refrigeration unit.

* * * * *